United States Patent [19]

Catanese et al.

[11] 4,350,922

[45] Sep. 21, 1982

[54] MULTICOLOR CATHODE-RAY TUBE WITH QUADRUPOLAR FOCUSING COLOR-SELECTION STRUCTURE

[75] Inventors: Carmen A. Catanese, Rocky Hill; Stanley Bloom, Bridgewater, both of N.J.

[73] Assignee: RCA Corporation, New York, N.Y.

[21] Appl. No.: 161,603

[22] Filed: Jun. 20, 1980

[51] Int. Cl.[3] ..... H01J 29/07

[52] U.S. Cl. ..... 313/402

[58] Field of Search ..... 313/403, 402

[56] References Cited

U.S. PATENT DOCUMENTS

| | | | |
|---|---|---|---|
| 4,059,781 | 11/1977 | Alphen et al. | 313/403 |
| 4,066,923 | 1/1978 | Esdonk | 313/402 |
| 4,112,563 | 9/1978 | Esdonk | 29/25.18 |
| 4,121,131 | 10/1978 | Esdonk et al. | 313/402 |
| 4,188,562 | 2/1980 | Oostrum | 313/402 |

FOREIGN PATENT DOCUMENTS

| | | | |
|---|---|---|---|
| 80200384.8 | 11/1980 | European Pat. Off. | 313/402 |
| 1509701 | 5/1978 | United Kingdom . | |

*Primary Examiner*—Robert Segal

*Attorney, Agent, or Firm*—E. M. Whitacre; D. H. Irlbeck; L. Greenspan

[57] ABSTRACT

CRT comprises a color-selection structure for producing a plurality of quadrupolar lenses, each lens defining a window for passing and focusing portions of electron beams to an associated color group of a target. The color-selection structure comprises (i) a metal masking plate having therein an array of substantially rectangular windows, each window having associated therewith (ii) a pair of first conductors insulatingly spaced from one major surface of the plate and located adjacent opposite sides of the aperture and (iii) a pair of second conductors insulatingly spaced from the other major surface of the plate and located adjacent opposte sides of the window. The CRT includes means for applying a voltage to said plate, means for applying a voltage to said pairs of first conductors and means for applying a voltage to said pairs of second conductors.

10 Claims, 5 Drawing Figures

MULTICOLOR CATHODE-RAY TUBE WITH QUADRUPOLAR FOCUSING COLOR-SELECTION STRUCTURE

This invention relates to a novel CRT (cathode-ray tube) having a focusing color-selection structure.

A commercial shadow-mask-type color television picture tube, which is a CRT, comprises generally an evacuated envelope having therein a target comprising an array of phosphor elements of three different emission colors arranged in color groups in cyclic order, means for producing three convergent electron beams directed towards the target, and a color-selection structure including a masking plate between the target and the beam-producing means. The masking plate shadows the target, and the differences in convergent angles permit the transmitted portions of each beam, or beamlets, to select and excite phosphor elements of the desired emission colors.

At about the center of the color-selection structure, the masking plate of a commercial CRT intercepts all but about 18% of the beam currents; that is, the plate is said to have a transmission of about 18%. Thus, the area of the apertures of the plate is about 18% of the area of the masking plate. Since there are no focusing fields present, a corresponding portion of the target is excited by the beamlets of each electron beam.

Several methods have been suggested for increasing the transmission of the masking plate; that is, increasing the area of the apertures relative to the area of the plate, without substantially increasing the excited portions of the target area. In one approach, each of the apertures of the color-selection structure is defined by a quadrupolar electrostatic lens which focuses the beamlets passing through the lens in one direction and defocuses them in another direction on the target depending upon the relative magnitudes and polarities of the electrostatic fields comprising the lens.

In one type of quadrupolar-lens color-selection structure described in U.S. Pat. No. 4,059,781 to W. M. van Alphen et al., a strong focusing quadrupolar lens is generated from voltages applied between two sets of substantially-parallel conducting strips, each set being orthogonally positioned with respect to the other, and insulatingly bonded at the intersections of the strips. One shortcoming of this structure is that the structure is mechanically weak due to the lack of an underlying, self-supporting member. Also, the structure consists of aligned rows and columns of apertures which may produce highly-visible moiré patterns on the target.

In another type of quadrupolar-lens color-selection structure described in the same patent, an apertured masking plate carries an array of conducting strips which are disposed between columns of the apertures and insulatingly spaced from one major surface of the plate. This structure has the disadvantage that the voltages required to generate the required focusing field for the lenses under a given set of conditions are about twice the voltages required for producing the lenses in the foregoing one type of structure. Thus, this other type of structure is a compromise whereby structural rigidity is obtained at the cost of increased voltage and electrostatic field strength. The increased voltage required for producing the quadrupolar lenses during the operation of the CRT is about 1,600 volts or more, which produces electrostatic fields which may result in electrostatic breakdown of many of the insulating materials that might be used to space the conducting strips from the plate.

SUMMARY OF THE INVENTION

The novel CRT is similar in structure to the prior CRTs mentioned above except for the color-selection structure, which, as in those prior CRTs, is for producing a plurality of quadrupolar lenses, each lens defining a window for passing and focusing portions of electron beams to an associated color group of the target. In the novel CRT, the color-selection structure comprises (i) a metal masking plate having therein an array of substantially rectangular apertures, each aperture having associated therewith (ii) a first pair of conductors insulatingly spaced from one major surface of the plate and located adjacent opposite sides of the aperture and (iii) a second pair of conductors insulatingly spaced from the other major surface of the plate and located adjacent opposite sides of the aperture. The CRT includes means for applying a voltage to said plate, means for applying a voltage to said first pairs of conductors and means for applying a voltage to said second pairs of conductors.

In a preferred form of the novel CRT, the phosphor elements are substantially parallel stripes and the masking-plate apertures are substantially rectangular and are arranged in columns that are substantially parallel to the stripes. The first pairs of conductors are substantially parallel conducting strips insulatingly supported on one major surface of the plate in the spaces between adjacent columns of apertures, and the second pairs of conductors are substantially parallel conducting strips insulatingly supported on the other major surface of the plate on the spaces between adjacent apertures. However, the first and second pairs of conductor strips may extend substantially parallel or substantially normal to one another.

By providing the second pairs of conductors in addition to the first pairs of conductors in the color-selection structure of the novel tube, the structure can be made as structurally strong and rigid as is necessary without being unduly thick, heavy or bulky. In addition, the improved structure can be operated at lower voltage differences, and hence lower electrostatic fields, than the latter type of structure mentioned above. The voltage differences and the fields generated are close to those employed in the one type of structure mentioned above, thereby conserving electric power and minimizing the possibility of electrostatic breakdown.

DETAILED DESCRIPTION OF THE PREFERRED EMBODIMENT

Figure 1:
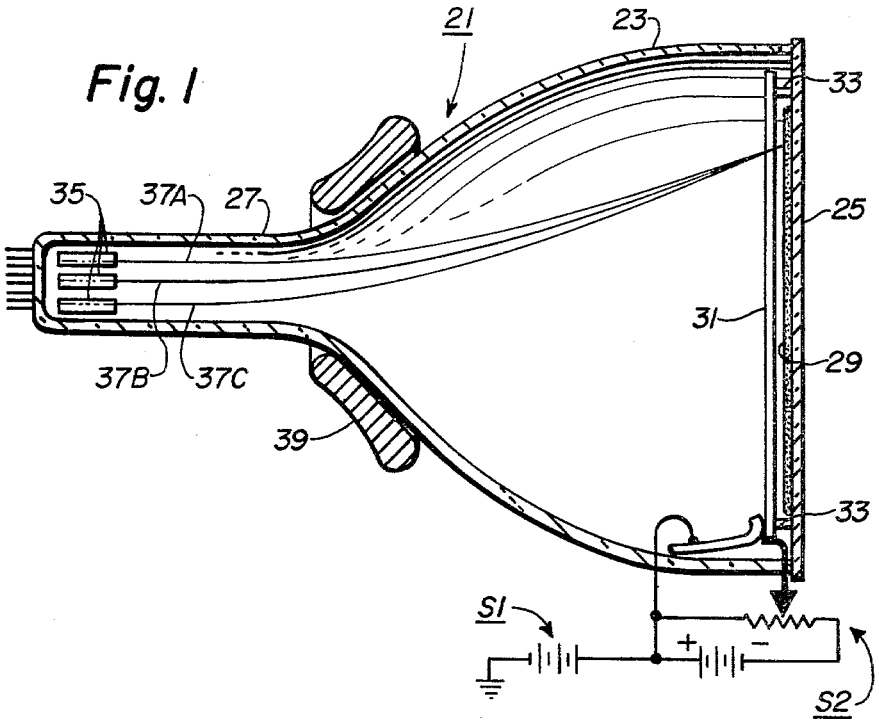
FIG. 1 is a partially-schematic sectional view of an embodiment of a novel CRT.

The novel color television picture tube 21 shown in FIG. 1 comprises an evacuated bulb 23 including a transparent faceplate 25 at one end and a neck 27 at the other end. The faceplate 25, which is flat, but may arch outwardly, supports a luminescent viewing screen or target 29 on its inner surface. Also, a color-selection structure 31 is supported from three supports 33 on the inside surface of the faceplate 25. Means 35 for producing three electron beams 37A, 37B and 37C are housed in the neck 27. The beams are generated in substantially a plane, which is preferably horizontal in the normal viewing position. The beams are directed towards the screen 29 with the outer beams 37A and 37C convergent on the center beam 37B at the target 29. The three beams may be deflected with the aid of deflection coils 39 to scan a raster over the color-selection structure 31 and the viewing screen 29.

Figure 2:
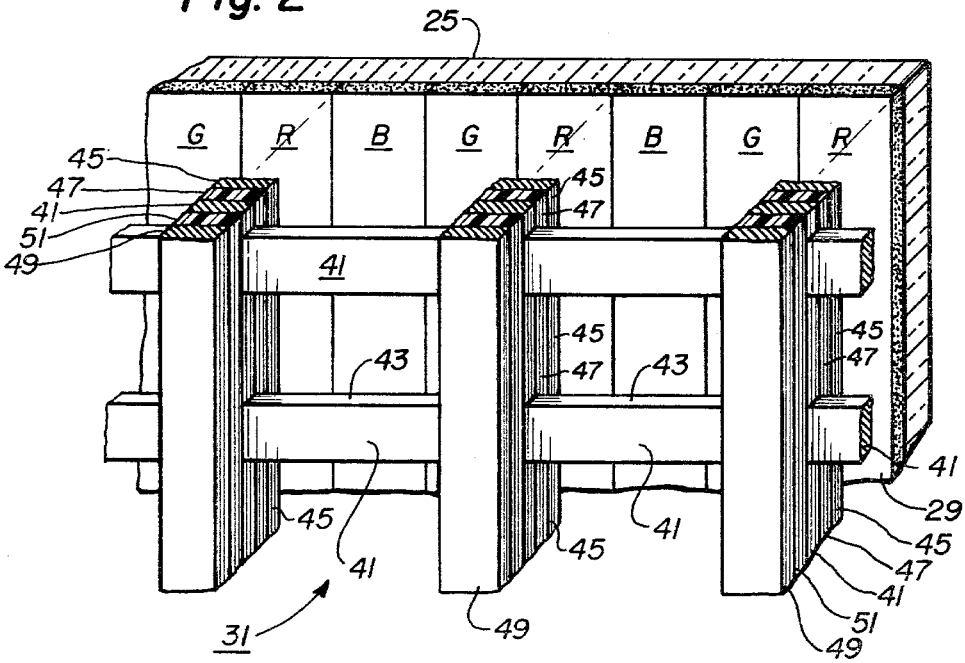
FIG. 2 is a perspective view of fragments of the color-selection structure and the viewing screen of the CRT shown in FIG. 1.

The viewing screen 29 and the color-selection structure 31 are described in more detail with respect to FIG. 2. The viewing screen 29 comprises a large number of red-emitting, green-emitting and blue-emitting phosphor stripes R, G and B respectively, arranged in color groups of three stripes or triads in a cyclic order and extending in a direction which is generally normal to the plane in which the electron beams are generated. In the normal viewing position for this embodiment, the phosphor stripes extend in the vertical direction.

The color-selection structure 31 comprises a masking plate 41 having a large number of rectangular openings or apertures 43 therein. The apertures 43 are arranged in columns, which are parallel to the long direction of the phosphor stripes R, G and B, there being one column of apertures associated with each triad of stripes. The green stripe G is at the center of each triad, and is centered opposite its associated column of apertures. The red stripe R is to the right and the blue stripe B is to the left of the green stripe G as viewed from the electron-beam-producing means 35. A first array of narrow conductors 45 is closely spaced from the screen side of the masking plate 41 by first insulators 47 that are of the order of 0.025 to 0.050 mm (1 to 2 mils) thick. A first conductor 45 extends down the space between each column of apertures 43 on the screen side of the masking plate 41 and opposite each triad boundary; that is, opposite the boundary between the red and blue stripes R and B. A second array of narrow second conductors 49 is closely spaced from the beam-producing side of the plate 41 by second insulators 51 that are of the order of 0.025 to 0.050 mm (1 to 2 mils) thick. A second conductor 49 extends down the space between each column of apertures 43 opposite each first conductor. The conductors 45 and 49 are substantially parallel to the stripes R, G and B. The apertures 43 are functionally electron-transmitting ports or windows.

In this embodiment, the apertures 43 at the center of the plate 41 are about 0.65 mm (26 mils) wide by 0.31 mm (12 mils) high. The apertures are spaced about 0.14 mm (6 mils) apart from adjacent apertures above and below. To the sides, the spacing is about 0.11 mm (4 mils). The conductors are about 0.15 mm (6 mils) wide and about 0.050 to 0.10 mm (2 to 4 mils) thick. The masking plate 41 is spaced about 12.7 mm (500 mils) from the phosphor stripes R, G and B.

Figure 3:
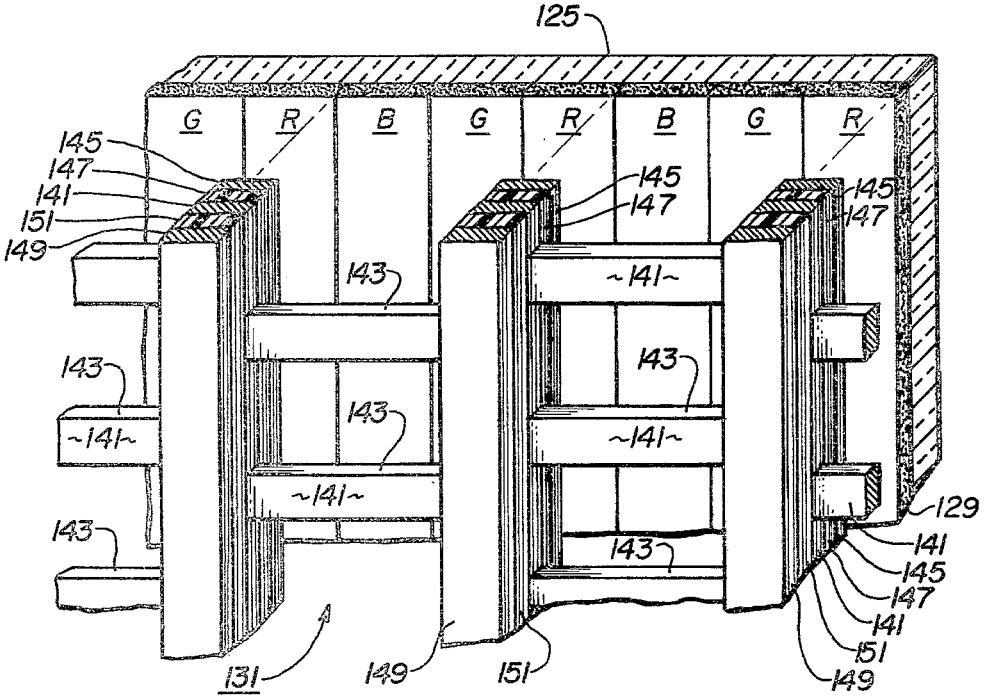
FIGS. 3, 4 and 5 are respectively, perspective views of fragments of modifications of the color-selection structure and the viewing screen of the novel CRT of FIG. 1. Similar structures have similar reference numerals except that 100, 200 and 300 respectively are added in FIGS. 3, 4 and 5.

All of the sizes disclosed herein for the color-selection structure are exemplary and may be varied to enhance one or more performance characteristics of the CRT. The apertures 43 are uniformly sized but may be, if desired, graded in size from the center to the edge of the masking plate 41. Also, the spacing between the masking plate 41 and the stripes R, G and B is uniform but may be graded from the center to the edge of the masking plate 41. In another alternative, as shown in FIG. 3, the apertures 143 in adjacent columns may be vertically offset from one another instead of being in a horizontal line or row as shown in FIG. 2. To improve the light output of the target, the surfaces of the stripes R, G, and B towards the electron-producing means may be coated with a light-reflective material, such as aluminum metal.

To operate the tube 21, the electron-beam-producing means 35 is energized with the cathode at essentially ground potential. A first positive voltage (V) of about 25,000 volts from a voltage source S1 is applied to the screen and to the masking plate 41, and a second positive voltage ($V-\Delta V$) of about 25,000 volts minus about 500 volts from a source S2 is applied to each of the first and second conductors 45 and 49. Three convergent beams 37A, 37B and 37C from the means 35 are made to scan a raster on the viewing screen 29 with the aid of the deflection coils 39. The beams approach the masking plate at different but definite angles. Each beam is much wider than the apertures and therefore spans many apertures. Each beam produces many beamlets, which are the portions of the beam which pass through the apertures and excite the phosphor stripes.

The electrostatic fields produced by the voltages on the conductors 45 and 49 cause those beamlets that pass through the apertures 43 to be deflected away from the conductors 45, thereby focusing the beamlets normal to the direction of the conductors 45 and 49, so that the beamlets are compressed in that direction. The electrostatic fields produced by the voltage on the plate 41 are masked where the conductors 45 and 49 overlay the plate 41. However, where the plate 41 is not overlaid by the conductors 45 and 49, the field produced by the voltage on the plate defocuses the beamlet parallel to the direction of the conductors 45 and 49 so that the beamlets are expanded in that direction. Because of the spacing between the masking plate 41 and the stripes R, G and B in combination with the different convergent angles, the beamlets produced by each beam all fall on phosphor stripes of the same emission color. The same deflection and focusing occurs at the apertures 43 as the center beam 37B scans across the viewing screen 29. Similarly, but at a different angle, one side beam 37A produces beamlets which fall on red-emitting stripes R; and the other side beam 37C produces beamlets which fall on blue-emitting stripes B.

The foregoing operation is to be compared with the CRT and the mode of operation disclosed in U.S. Pat. No. 4,059,781 to W. M. van Alphen et al. at FIG. 6. In that prior structure (FIG. 6 of the patent), only one set of conductors is disclosed. The one set of conductors carries a positive voltage of about 25,000 volts minus about 1,600 volts ($V-\Delta V$), and the masking plate and screen carry a positive voltage of about 25,000 volts (V). The beamlets passing through a particular aperture are focused in the direction normal to the length of the conductors and defocused in the direction parallel to the length of the conductors, so that the beamlets fall on a particular phosphor stripe of an associated triad. In the novel CRT, by adding a second set of conductors as described above, the same but enhanced focusing and defocusing effects are realized with lower voltage differences ($\Delta V$) and similar electrostatic fields.

Figure 4:
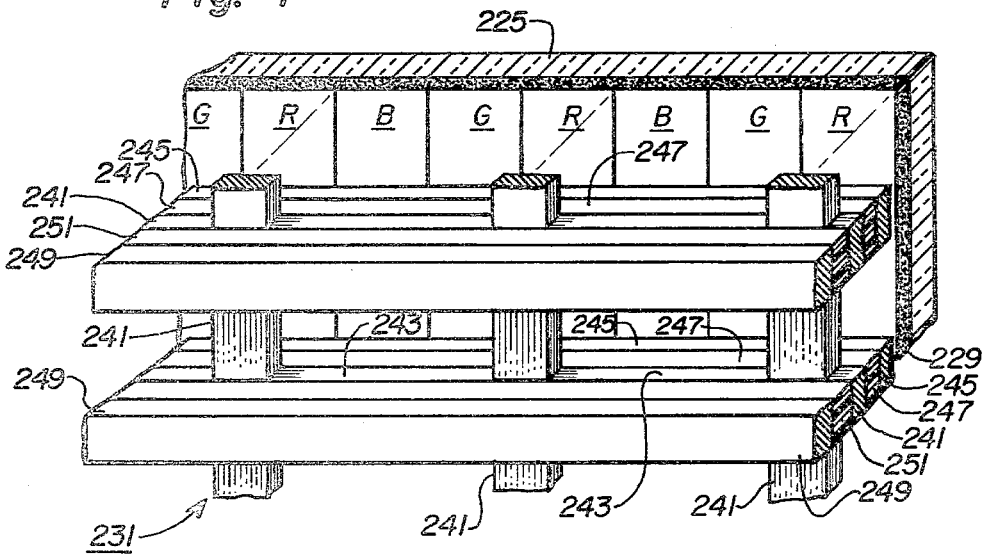

As shown in FIGS. 2 and 3, the color-selection electrode of the novel CRT includes two sets of conductors, both of which are parallel to the phosphor stripes and vertical in the normal viewing direction. A further variation of the novel CRT shown in FIG. 4 is similar to the embodiment shown in FIG. 2, except that the narrow conductors 245 and 249 of the two sets are parallel to each other and insulatingly supported in the spaces between the apertures, but are normal to the phosphor stripes which are vertical and in the normal viewing direction. When operating this structure, the conductors are biased positively with respect to the masking plate 241. Thereby, the beamlets are focused in the horizontal direction and defocused in the vertical direction (as normally viewed) as in the embodiment shown in FIG. 2.

Figure 5:
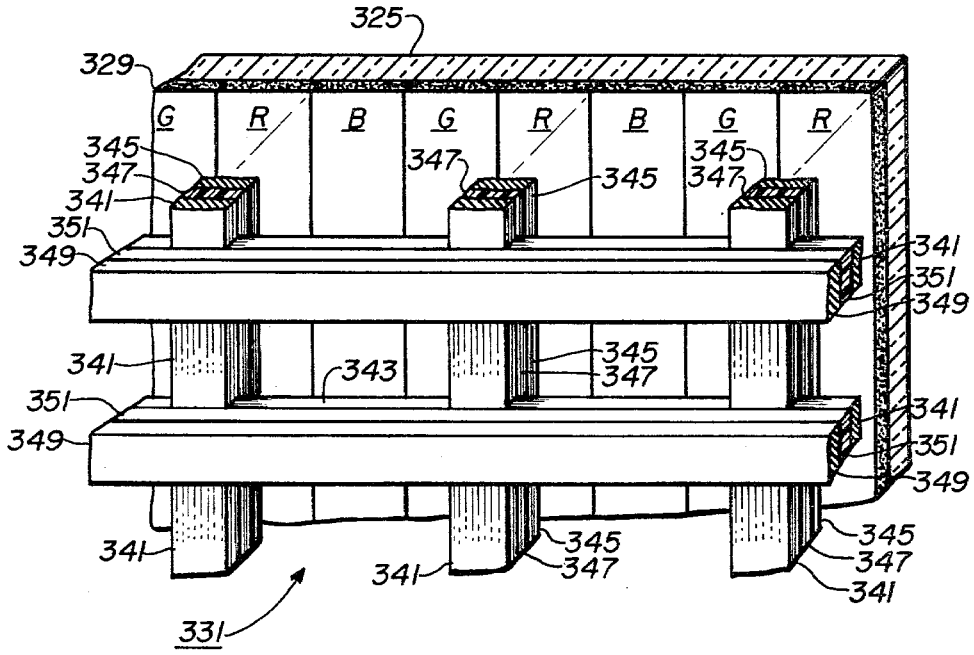

A further alternative illustrated in FIG. 5 is similar to the embodiment shown in FIG. 2 except that the first set of conductors 345 is parallel to the phosphor stripes 329, and the second set of conductors 349 is normal to the phosphor stripes 329. In operating this alternative, the conductors 345 of the first set are biased negatively with respect to the plate 341, and the conductors 349 of the second set are biased positively with respect to the plate 341.

Further variations of the novel CRT employ a screen wherein the phosphor stripes are substantially horizontal as normally viewed; that is, the screens shown in FIGS. 2 to 5 are rotated about 90°. With substantially-horizontal phosphor stripes, each of the alternatives mentioned above may be employed but with the color-selection electrode also rotated by the same angle as the screen. The applied voltages are the same as in the above-mentioned alternatives.

We claim:

1. In a cathode-ray tube including (a) a target comprising an array of phosphor elements of different emission colors arranged in cyclic order in adjacent color groups, each group comprising an element of each of said different emission colors, (b) means for producing a plurality of electron beams directed toward said target, and (c) a color-selection structure positioned between said target and said beam-producing means, said color-selection structure having a plurality of means for transmitting portions of said beams to associated color groups of said target and means for focusing without deflecting said beam portions, said structure comprising (i) a metal masking plate having two opposed major surfaces and having therein an array of substantially rectangular windows, each window having associated therewith (ii) a pair of first conductors insulatingly spaced from one major surface of said masking plate and located adjacent opposite sides of said window, each window being associated with only one color group, the improvement wherein said color-selection structure includes (iii) a pair of second conductors insulatingly spaced from the other major surface of said plate and located adjacent opposite sides of each of said windows.

2. The tube defined in claim 1 including means for applying a voltage to said plate, means for applying a voltage to said first conductors and means for applying a voltage to said second conductors.

3. The tube defined in claim 1 wherein said phosphor elements are in the form of substantially parallel stripes, and said windows are arranged in columns that are substantially parallel to the lengths of said stripes.

4. The tube defined in claim 3 wherein said first conductors are located adjacent the sides of said windows that are substantially parallel to the lengths of said stripes and said second conductors are located adjacent the sides of said windows that are substantially parallel to the lengths of said stripes.

5. The tube defined in claim 4 wherein the windows of adjacent columns are aligned in a row.

6. The tube defined in claim 4 wherein the windows of adjacent columns are offset from one another.

7. The tube defined in claim 3 wherein said first conductors are located adjacent the sides of said windows that are substantially parallel to the lengths of said stripes, and said second conductors are located adjacent the sides of said windows that are substantially normal to the lengths of said stripes.

8. The tube defined in claim 3 wherein said first conductors are located adjacent the sides of said windows that are substantially normal to the lengths of said stripes, and the second conductors are located adjacent the sides of said windows that are substantially normal to the lengths of said stripes.

9. The tube defined in claim 8 wherein the windows of adjacent rows are aligned in columns.

10. The tube defined in claim 3 wherein said target comprises an array of phosphor elements of three different colors, and said beam-producing means produces three convergent in-line electron beams.

* * * * *

UNITED STATES PATENT AND TRADEMARK OFFICE
CERTIFICATE OF CORRECTION

PATENT NO. : 4,350,922

DATED : September 21, 1982

INVENTOR(S) : Carmen Anthony Catanese and Stanley (NMN) Bloom

It is certified that error appears in the above-identified patent and that said Letters Patent is hereby corrected as shown below:

Abstract, line 10 after "sides of the" change "aperture" to --window--

Signed and Sealed this

*Twenty-third* Day of *November 1982*

[SEAL]

*Attest:*

GERALD J. MOSSINGHOFF

*Attesting Officer*

*Commissioner of Patents and Trademarks*

Disclaimer 4,350,922.—*Carmen A. Catanese,* Rocky Hill, and *Stanley Bloom,* Bridgewater, N.J. MULTICOLOR CATHODE-RAY TUBE WITH QUADRUPOLAR FOCUSING COLOR-SELECTION STRUCTURE. Patent dated Sept. 21, 1982. Disclaimer filed Nov. 16, 1983, by the assignee, *RCA Corp.*

Hereby enters this disclaimer to all claims of said patent.

[*Official Gazette January 3, 1984.*]